US006655088B1

(12) United States Patent
Hörmann

(10) Patent No.: US 6,655,088 B1
(45) Date of Patent: Dec. 2, 2003

(54) SAFETY BREAK FOR AN OVERHEAD DOOR

(75) Inventor: Thomas J. Hörmann, St. Wendel (DE)

(73) Assignee: Hörmann KG Brockhagen, Steinhagen (DE)

( * ) Notice: Subject to any disclaimer, the term of this patent is extended or adjusted under 35 U.S.C. 154(b) by 0 days.

(21) Appl. No.: 09/744,755

(22) PCT Filed: Jul. 23, 1999

(86) PCT No.: PCT/DE99/02272

§ 371 (c)(1),
(2), (4) Date: Feb. 23, 2001

(87) PCT Pub. No.: WO00/06861

PCT Pub. Date: Feb. 10, 2000

(30) Foreign Application Priority Data

Jul. 27, 1998 (DE) ..... 198 33 724
Dec. 2, 1998 (DE) ..... 198 55 697

(51) Int. Cl.[7] ..... E05D 13/00; E05B 9/84

(52) U.S. Cl. ..... 49/200; 49/322; 49/445; 160/302

(58) Field of Search ..... 49/199, 200, 322, 49/445; 160/191, 192, 318, 302, 291

(56) References Cited

U.S. PATENT DOCUMENTS

| | | | | | |
|---|---|---|---|---|---|
| 1,922,370 | A | * | 8/1933 | Johnson et al. | 160/191 |
| 1,992,006 | A | * | 2/1935 | Greegor | 16/198 |
| 2,784,810 | A | * | 3/1957 | Ulmann | 188/166 |
| 4,448,290 | A | * | 5/1984 | Reid et al. | 188/82.7 |
| 4,582,179 | A | * | 4/1986 | Nelson | 188/184 |
| 4,907,679 | A | * | 3/1990 | Menke | 188/189 |
| 5,127,631 | A | * | 7/1992 | Rlaig | 254/267 |
| 5,310,022 | A | * | 5/1994 | Sheridan et al. | 187/305 |
| 5,494,093 | A | * | 2/1996 | Eiterman | 160/300 |
| 5,632,063 | A | * | 5/1997 | Carper et al. | 16/198 |
| 5,931,212 | A | * | 8/1999 | Mullet et al. | 160/188 |
| 5,971,055 | A | * | 10/1999 | Rohaut | 160/300 |

* cited by examiner

*Primary Examiner*—Gregory J. Strimbu
(74) *Attorney, Agent, or Firm*—Max Fogiel

(57) ABSTRACT

An arrangement for monitoring a condition of a counterbalance torsion spring in an overhead door or gate and preventing the door or gate from accidentally slamming shut or dropping too rapidly when the spring fails. The arrangement includes a drum mounted on a shaft which transmits the torque of the spring to the drum. During normal operation a sensor and release assembly maintains a catcher in a inactive position and when the spring fails, the sensor and release assembly allows the catcher to move to an active position and engage a grabber disposed on an inside surface of the drum to block rotation of the drum and therefore movement of the door or gate.

12 Claims, 3 Drawing Sheets

SAFETY BREAK FOR AN OVERHEAD DOOR

BACKGROUND OF THE INVENTION

The present invention concerns a device for monitoring the condition of a spring employed subject to tension in a door or gate, especially a torque spring employed to equilibrate the one or more panels in an overhead door or roll-up gate and prevent the door or gate from slamming shut, dropping too rapidly. etc., the device including a blocker, a torque transmitter, a catcher, and a sensor and release assembly that senses the presence or absence of tension, whereby the torque transmitter specifically comprises a cable or chain-wound shaft or similar torque-accommodating component that is subject to the force exerted by the spring as long as the spring is intact, whereby, as the gate or door opens and closes, the blocker rotates around a shaft along with the torque transmitter and is mechanically coupled to an especially detented grabber, whereby the blocker can, subject to the grabber, block the rotation of the torque transmitter and hence the motion of the door, whereby the catcher can be shifted out of an inactive position, wherein it is disengaged from the grabber, and into an active position, wherein it engages the grabber, and whereby the sensor and release assembly constantly senses the presence or absence of tension in the spring and, if the spring breaks and the tension is accordingly eliminated, senses the absence and shifts the catcher out of its inactive position and into its active position, allowing the blocker to block the rotation of the torque transmitter.

A spring-condition monitoring device of the aforesaid genus is known from European Application 0 151 427 and its related patent, the entire disclosures in both of which are herein explicitly referred to.

One practical embodiment of this known spring-condition monitoring device is mainly intended to prevent an overhead door from falling when a torque spring that engages a shaft with a tensioning component, a Bowden cord, for example, wound around it breaks. Considerable torque must be accommodated when such a door is especially heavy, as is true of multiple-paneled factory doors for example. Some spring-condition monitoring devices must accordingly be designed to withstand torques of more than 800 Nm and reliably prevent shafts subject to considerable torque due to the weight of the door from spinning.

Previous attempts to solve this problem have relied on wheels on the shaft with ratchets that can be engaged by catches in the form of barrier pawls to prevent the motion. In its inactive position, the pawl is secured against a bolt in opposition to the direction the ratchet wheel is tensioned in. The bolt is part of a sensor and release assembly that senses the presence or absence of tension in the torque spring. If the spring breaks, the sensor and release assembly releases the bolt and allows it to disengage from the pawl. The bolt is for this purpose preferably directly connected to the torque spring's seat, usually in the form of a resilient cone, and the spring's tension forces it to engage with the pawl. The cone in one embodiment employed in spring-breakage safety devices in industrial gates can for this purpose pivot through a narrow range of angles around an axis that parallels the axis of rotation, allowing the bolt to carry out a rotation different from the circumferential direction around the axis of rotation and accordingly be easier to move out of the range of the barrier pawl and accordingly release.

Many other embodiments of the sensor and release assembly, however, electrical, electropneumatic, and pneumatic for example, are also conceivable. The sensor and release assembles in such embodiments can be strain gages or pressure gages for example instead of mechanical components.

There is, however, a drawback to the known spring-condition monitoring devices in that the require considerable space and material, especially when powerful torques necessitate longer radii for the ratchet wheel or similar blocker and hence a more complicated catcher. When access from outside is excluded, a housing around the known blocking mechanisms (blockers and catchers) will be necessary.

SUMMARY OF THE INVENTION

The object of the present invention is accordingly an advanced spring-condition monitoring device of the aforesaid genus that will occupy less space and preferably require less material as well while allowing even powerful torques to be blocked in the event of a broken spring.

This object is attained in accordance with the present invention in a spring-condition monitoring device of the aforesaid genus in that the wall of the blocker is essentially directed radially inward toward the axis, the grabber being mounted on the wall, and in that the catcher is provided with a section that is or can be accommodated radially inside the wall and can move radially outward into engagement with the grabber during its motion into the active position.

In contrast to the known ratchet wheel, which is an extra component with notches or similar structures, the blocker in accordance with the present invention accommodates the grabber in its interior, the catcher engaging it in an outward motion if the spring breaks. For the same grabbing radius, accordingly, the catcher can be much smaller and require less material than at the state of the art. A lower-mass catcher also has the advantage of less inertia, allowing more rapid blocking. Again, since a blocking mechanism comprising a blocker and a catcher accommodated inside it will be relatively well protected from exterior access and actions, no separate housing will be necessary. Still another advantage is that the blocker can be an annular section, a hollow flowerpot-shaped component preferably accessible from outside, or a drum.

The blocker in one particularly preferred embodiment of the present invention is at least part of, and preferably entirely, a drum that traction means can be wound around, the other end of the means being connected to the gate or door, preferably to the area at the bottom when the gate or door is closed. This blocker is accordingly not a separate component and can be integrated into a winding mechanism that is already present. In this embodiment, the entire spring-condition monitoring device itself can even be accommodated inside the winding mechanism, entirely enclosed, that is. The drum or winding mechanism itself can be or can be employed as a blocker more or less in the form of a hollow ratchet wheel. The result will be a large enough ratchet wheel with a long enough radius to comply with the space occupied by the drum or similar winding mechanism. The resulting lever arm will be long in relation to the axis of torque. Another major advantage of this embodiment is its extremely short force-application channel. When engaged, the force will flow from the gate or door through the traction means and hence directly to the catcher, which will divert the force out through its bearing. The force in the spring-condition monitoring device in accordance with the present invention will accordingly not flow into the torque shaft. An embodiment without a torque shaft is accordingly also conceivable when the torque is otherwise transmitted from the spring to the drum.

It will be preferable, because independent of sources of such outside energy as compressed air or electricity, for the catcher to be a mechanism of some sort, the catching section being provided on a barrier pawl that is radially outwardly resilient in relation to the axis of rotation and in particular spring-loaded, allowing it to engage detents on the radially inward-directed wall and accordingly constituting the grabber.

To ensure rapid and reliable release of the blocker in the event that the spring breaks, it is also preferable for the catcher to be provided with a supporting surface that during the inactive phase serves to support the catcher against a securing component that can be moved out of the way of the catcher by the sensor and release assembly in the event of a broken spring and that slopes in relation to the path of the securing component, allowing that component to be forced, as the catcher moves in the event of a broken spring, out of the path of the catcher and into the active position.

If for example a barrier pawl is employed as a catcher, the barrier pawl is mounted pivoting outside a traction-means shaft, the traction-means shaft serves as a torque transmitter, the barrier pawl is as at the state of the art retained in its inactive position by a securing component in the form of a bolt, the bolt is secured by a spring-loaded cone, and the spring-loaded cone is also mounted pivoting outside the shaft, only a transverse component of the barrier pawl's tensioning force will be applied to the bolt, and will indeed be applied such as to ensure that the barrier pawl will rest against the bolt through the intermediary of the supporting surface, which does not extend perpendicular to the barrier pawl's pivot. If the spring breaks and the spring-loaded cone moves along with the bolt through the accordingly provided range of angles around its pivot and into it final barrier position, the motion will be supported by the barrier pawl's tension.

The catcher in another preferred embodiment of the present invention is a lever that pivots around an axis paralleling the axis of rotation and is resiliently tensioned into the active position with an arm that includes the catching section and especially the barrier pawl. When the lever includes another arm that operates in conjunction with the sensor and release assembly's release mechanism and especially includes the supporting surface, the available space will be better exploited, and the actions used for releasing the blocker can be reversed. The second lever arm can in this event be employed for polling, of a spring-loaded cone motion in the event of a broken spring for example, a small component of the resilient pawl-tensioning force acting on the cone bolt by way of a steeply sloping plane (the supporting surface).

In the event of a broken spring, the release assembly, the bolt fastened to the spring-loaded cone or another securing device or the rest of the securing component will be tensioned not only into its or their release state but also backward impacting or backward bouncing. To prevent such a backward bouncing from reaching the once released second lever arm again, the second lever arm will pivot entirely out of range of the release mechanism and especially out of the path traveled by the securing component as the lever moves into the active position.

In one preferred version, the lever will be positioned to allow the first lever arm to be subjected in the active position to compressive force exerted by the blocking motion of the gate or door or similar structure. A lever arm thus subjected to compressive force offers advantages with respect to conserving material beyond those of a tensioned pawl in that it will lack the hook needed for a ratchet lever, and the free end of the arm can constitute a pawl-engagement section.

The first lever arm in another preferred embodiment of the present invention is a barrier pawl with a lug that engages one of the detents on the pawl and is provided with a sloping surface that slides over a matching sloping surface on the detent when the lever pivots in the event of a broken spring, allowing the lever to enter its final active position before any significant torque can be transmitted. The free end, constituting the catching section, of the first lever arm can itself act as or be provided with such a lug in the form of a bent section.

The embodiment with the matching sloping surfaces is of particular advantage in that traction-means drums are often extruded in a material that is more brittle than sheet metal for example. It will accordingly be of advantage for the forces that actually need to be accommodated to be initially applied when at all possible at the large-surface engagement between the lug and the matching detent flank. The grabber in the last advantageous embodiment hereintofore described drags over its sloping detent flank the equivalently sloping lug radially outward as far as the foot of the detent, allowing a large contact surface between the lug and the detent's flank due to the associated sliding traction. This feature is of particular advantage in conjunction with a lever arm that can be subjected to pressure in that in an arm that is subjected to traction the slope of the flank would need to be so steep that in extreme cases the fracture resistance of the detents would suffer.

The radially inward-directed wall that supports (or constitutes) the grabber need not be continuous. It can be provided with gaps or even extend over only part of the circumference of the blocker. The wall need not be directed precisely radially inward in the geometrical sense. It can for example be provided everywhere with pawled areas to the extent that it will have no area perpendicular to the radial. What is important is that it face inward essentially or on the whole to the extent that the grabber provided on it will be radial accessible from inside.

Instead of being constantly radially inside the inward-directed wall, the catching section can assume a disengaged position during normal operation that is axially displaced for example outside the areas surrounded by the wall, while being in that area at least during the release motion, moving, that is, into the area during the release motion and radially outward in relation to the axis of rotation into the grasping position.

BRIEF DESCRIPTION OF THE DRAWINGS

One embodiment of the present invention will now be specified by way of example with reference to the accompanying drawing, wherein.

DESCRIPTION OF THE PREFERRED EMBODIMENTS

Figure 1:
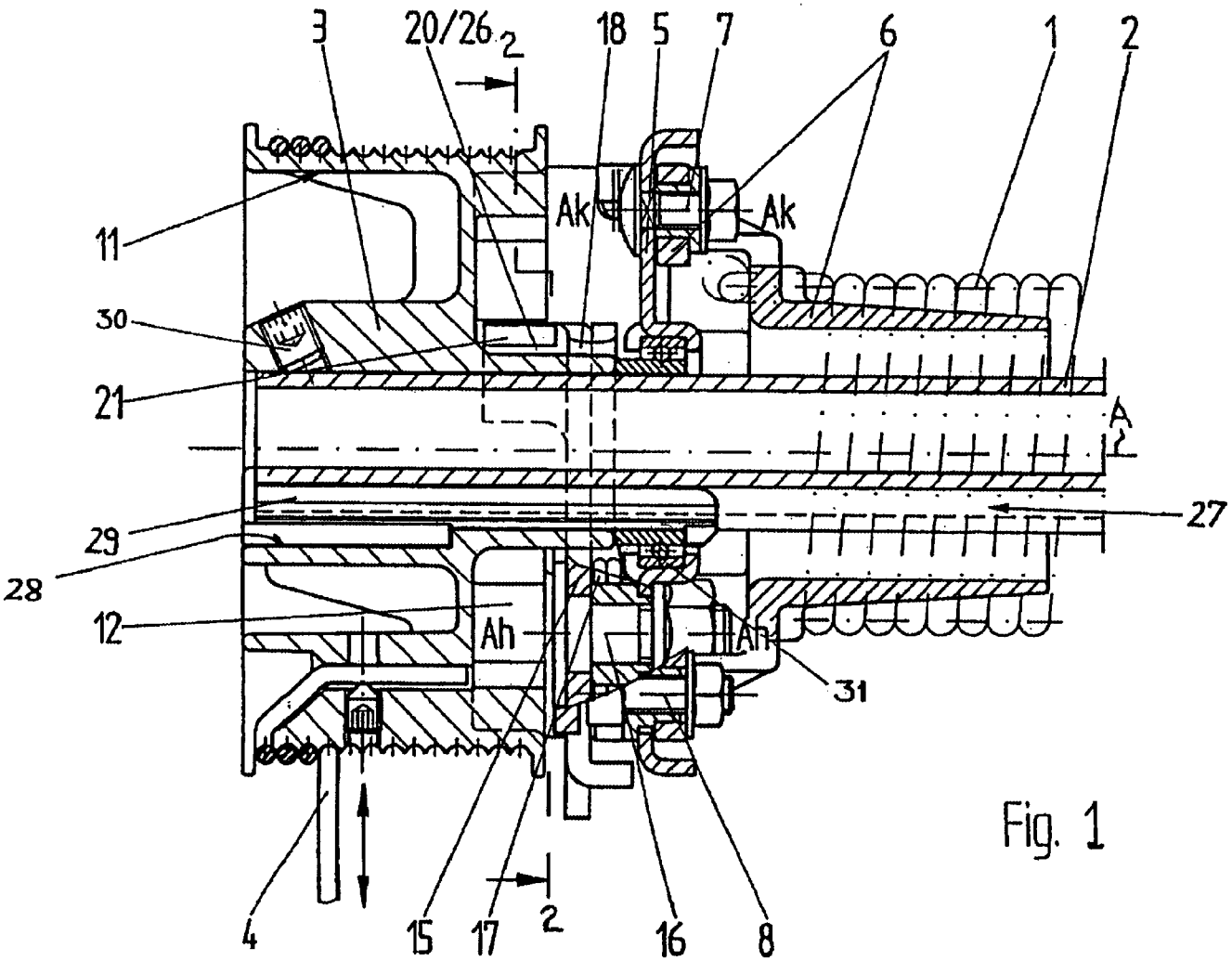
FIG. 1 is a schematic view dissected along the line 1—1 in FIG. 2 of a lateral end of a torque-spring gate-panel equilibrator provided with a spring-condition monitoring device.
Figure 2:
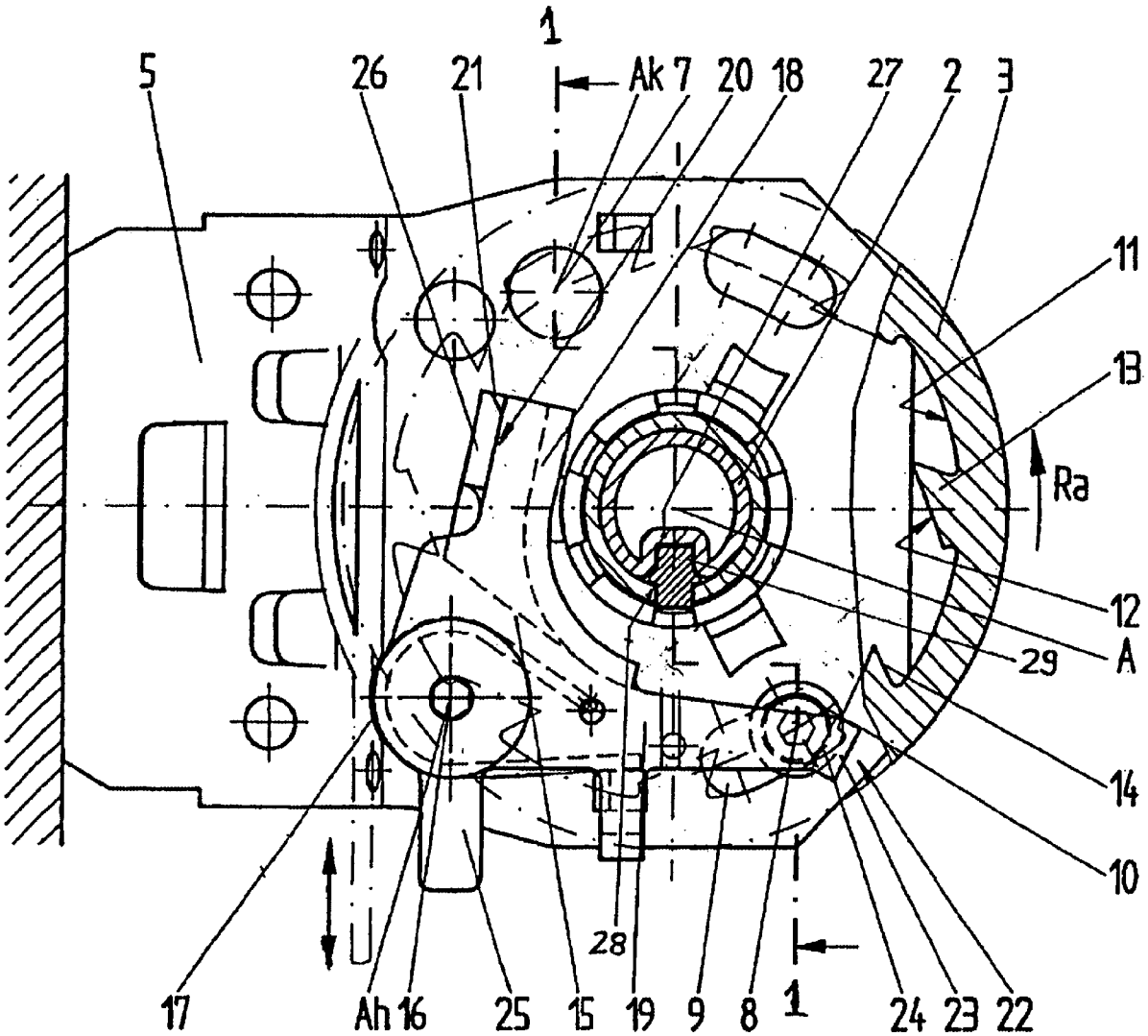
FIG. 2 is a schematic view of the equilibrator illustrated in FIG. 1 dissected along the line 2—2 in FIG. 1.

FIG. 1 illustrates the lateral end of a torque-spring gate equilibrator of the type employed for example with an overhead gate or door. A tensioned torque spring 1 equilibrates the gate's panels. Its torque is transmitted to a cable-winding drum 3 by way of a torque-transmitting shaft 2. An unillustrated gate is suspended with its weight resting on a cable 4 that can be wound onto drum 3. Shaft 2 is suspended on a shaft holder 5. The unillustrated end of spring 1 is connected to shaft 2. Its illustrated end faces drum 3 and rests on a cone 6. Cone 6 pivots by way of a bolt 7 around an axis Ak that parallels the axis A of rotation of shaft 2. Another bolt 8 is fastened to cone 6 opposite first bolt 7 in relation to axis A. Second bolt 8 travels back and forth in an angular slot 9 (FIG. 2) in shaft holder 5, allowing cone 6 to pivot through a narrow range of angles around axis Ak. Spring 1 maintains cone 6 under tension, forcing second bolt 8 tight against one end 10 of slot 9 as illustrated in FIG. 2.

Drum 3 and shaft 2 are coupled together and rotate jointly. The drum is suspended floating or as will be specified hereinafter. At a point on its radially inward wall 11 that is accessible from the end toward spring 1 drum 3 is provided with a grabber 12. Distributed along the circumference of grabber 12 are several detents 13. Each detent 13 is provided with a radially sloping flank 14 and is oriented in the wind-off direction Ra, in the sense, that is, that drum 3 rotates in as the gate closes and cable 4 unwinds.

Figure 3:
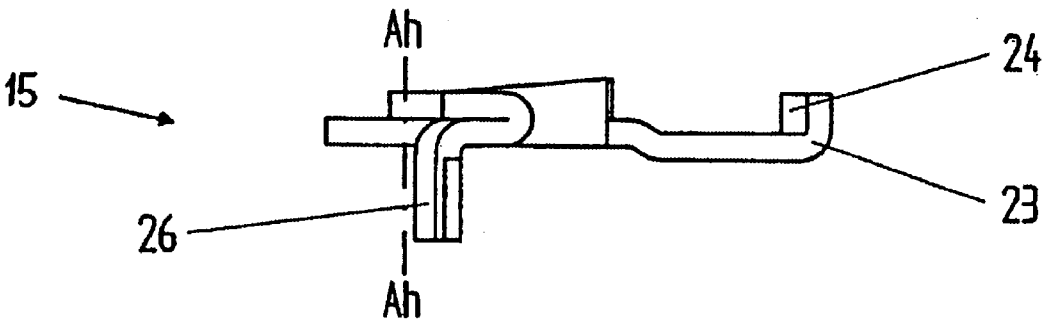
FIG. 3 is an overhead view of the lever employed as a catcher in the device illustrated in FIG. 1.

If the spring breaks, the rotation of drum 3 will be blocked by a catcher in the form of a lever 15. Lever 15 pivots on a third bolt 16 around an axis Ah that also parallels axis A of rotation. A resilient component 17 maintains lever 15 in an unillustrated active position, wherein it engages the grabber 12 on drum 3 and blocks the drum. The lever 15 illustrated in FIG. 2 is tensioned to pivot counterclockwise. Lever 15 is, as will be particularly evident from FIG. 3, provided with two arms 18 and 19, the second extending at an angle to the first.

Figure 4:
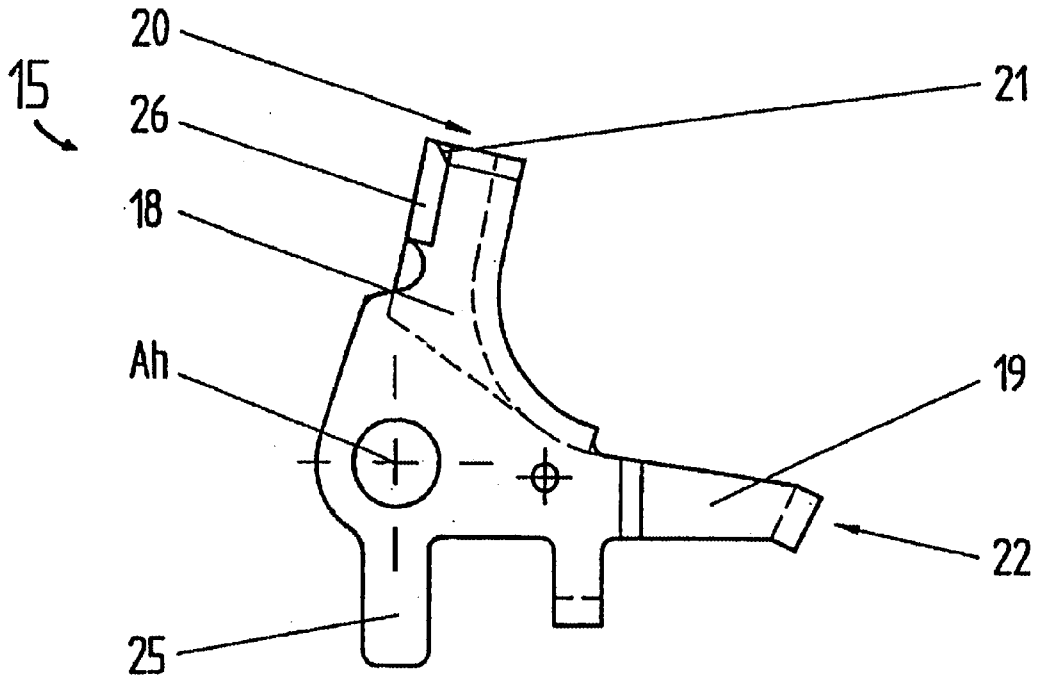
FIG. 4 is a frontal view of the lever illustrated in FIG. 3.

The free end 20 of first lever arm 18 is provided (FIGS. 4 and 1) with a lug 26 that extends into drum 3 and acts as a catching section. The end 20 in the illustrated example is bent, and only the bent section, which constitutes lug 26, extends into the drum, the rest of lever 15 remaining axially outside. One edge of end 20 (lug 26) extends in opposition to wind-off direction Ra and is provided with a sloping surface 21 that matches flank 14.

Second lever arm 19 rests in the inactive position illustrated in the figures, wherein drum 3 is not engaged by 15 and can rotate unobstructed, against second bolt 8, which is maintained by spring 1 at the first end 10 of slot 9. The free end 22 of second lever arm 19 is for this purpose also bent, specifically axially toward spring 1. The result is a surface 24 on the side of bend 23 facing lever axis Ah that supports second lever arm 19 and hence the lever 15 as a whole in opposition to the tension exerted by the resilient component 17 on second bolt 8. Supporting surface 24, however, does not entirely face axis Ah, but slopes, resting against second bolt 8 like a skewed plane and subjecting it to a transverse component of the force exerted by resilient component 17 against its seat at the first end 10 of slot 9.

Lever 15 also has a third arm 25 that extends between shaft holder 5 and drum 3, facilitating manipulation of the lever.

A rigid coupling between shaft 2 and drum 3 is ensured by a grooved area 27 and 28 respectively on each. A locking structure in the form of a key 29 or similar component is driven into areas 27 and 28. In addition to preventing relative rotation between shaft 2 and drum 3, key 29 also clamps the two together and prevents relate displacement. Furthermore, drum 3 is provided with a setscrew 30 to prevent displacement on the part of shaft 2.

A ball bearing 31 for the torque shaft has been impressed into shaft holder 5.

The reader is expressly referred for further explanation and for discussion of alternative embodiments of the torsion-spring gate-panel equilibrator, and especially of the components of interest in the present context, to European Published Application 0 151 427.

When the equilibrator is operating normally, spring 1 transmits its supporting force to shaft holder 5 by way of first bolt 7 and of second bolt 8, at the end 20 of slot 9. Drum 3 is accordingly tensioned in opposition to wind-off direction Ra, and the weight of the gate on cable 4 is relieved. The gate can easily be opened and closed, cable 4 winding and unwinding as drum 3 rotates. Lever 15 is retained in its inactive position by a securing component in the form of second bolt 8.

Without a device for monitoring the condition of spring 1, the total weight of the gate would rest on cable 4 without any counterweight in the event of a broken spring, and the total mass would crash down. To prevent the gate from falling if the spring breaks, the present equilibrator is provided with a spring-condition monitoring device consisting of a blocking assembly comprising lever 15 and grabber 12 and a sensor and release assembly comprising cone 6 in conjunction with slot 9, its end 10, and bolts 7 and 8. The sensor and release assembly immediately senses through its constant contact with spring 1 any absence of tension in the spring and releases blocker 15 and 12, blocking the unwinding rotation of drum 3 and preventing the gate from falling.

If spring 1 breaks, cone 6 is released and moves back around its axis Ak along the range of angles prescribed by slot 9. Second bolt 8 accordingly disengages from the first end 10 of the slot and travels along the slot away from that end. This motion is promoted by the position of lever 15 by way of the supporting surface 24, acting as a steeply sloping plane in relation to second bolt 8 and by the tension exerted by resilient component 17 until supporting surface 24 loses contact with bolt 8. Subsequently, lever 15 moves, driven by resilient component 17, into its active position. Simultaneously, second lever arm 19 pivots entirely out of the range of slot 9 and accordingly out of the range of the release assembly that includes bolt 8, so that, even if the assembly recoils, it will not interfere with the once initiated motion of lever 15. As lever 15 continues to move out of the inactive position and into the active position, the sloping surface 21 on the end 20 of first lever arm 18 will come into contact with one of the matching detent flanks 14. Due to the matching slope of flank 14, it will draw first lever arm 18 radially out, and the lever 15 will accordingly be driven by a sort of "sloping-plane engagement" between flank 14 and sloping surface 21 (whereby curved or angled slopes are also conceivable and provided, depending on the particular pivoting or levering motions desired) and finally shifted into its active position by resilient component 17. In the active position, the free end 20 of first lever arm 18 rests against the flank by way of sloping surface 21 and, surface to surface, by way of the edge of the detent's base that includes sloping surface 21, against grabber 12, against, that is, the inward-directed wall 11 of drum 3, blocking the drum, whereupon all the torque that occurs is transmitted directly to shaft holder 5 from drum 3 and its detents by way of first lever arm 18, subjected to pressure, and third bolt 16. The path of the flowing force in the catching situation is accordingly very short, and in particular the force that is to be diverted out does travel by way of shaft 2. This short path also contributes to the rapid and undelayed response. Furthermore, since fewer components are stressed, the spring-condition monitoring device will be more reliable than previous systems.

Thus, various components operate in conjunction in the embodiment specified herein, allowing operation that is in particular small-scale while still employing a relatively long detent-lever arm and, in terms of the force being induced, reliable and extensive, whereby any recoil on the part of the spring as it breaks will not be able to impede the once initiated barrier effect.

Important aspects of the spring-condition monitoring device hereintofore specified will now be summarized with reference to FIG. 1.

To create a device for monitoring the condition of a torque spring (1) employed to equilibrate the one or more panels in an overhead door or roll-up gate, a spring-condition monitoring device is proposed wherein in the event of a broken spring the radially outward catching section (18) of a catcher (15) engages and blocks a grabber (12) on the radially inward directed wall (11) of a blocker (3) that rotates as the gate opens and closes. The blocker is preferably an already present traction-means drum (13) and the grabber is preferably situated in an area of the wall that is accessible from outside.

List of Parts

1. torque spring
2. torque shaft
3. cord-winding drum
4. cord
5. shaft holder
6. cone
7. first bolt
8. second bolt
9. slot
10. first end of slot
11. radially inward-directed wall
12. grabber
13. detent
14. detent flank
15. lever
16. third bolt
17. resilient component
18. first lever arm
19. second lever arm
20. free end of first lever arm
21. sloping surface
22. free end of second lever arm
23. bend
24. supporting surface
25. third lever arm
26. barrier lug
27. grooved area of torque shaft
28. grooved area of drum
29. key
30. setscrew
31. ball bearing
Ah. lever axis
Ak. cone axis
A. torsion-spring axis
Re. cable wind-off direction

What is claimed is:

1. An arrangement for monitoring a torsion spring in an overhead door for counterbalancing at least one panel in said overhead door to prevent said overhead door from accidentally slamming shut or dropping too rapidly, comprising: a blocker, a torque transmitter, a catcher, and a sensor and release assembly for sensing torsion in the spring; said torque transmitter being subject to a force exerted by the spring as long as the spring is intact, said blocker rotating around an axis along with said torque transmitter and being mechanically coupled to a detented grabber as said overhead door opens and closes; said blocker blocking rotation of said torque transmitter and thereby motion of the overhead door depending on the catcher, said catcher being shiftable out of an inactive position disengaged from the grabber and into an active position, said catcher engaging said grabber in said active position; said torsion being absent when said spring breaks, said catcher being shifted out of said inactive position and into said active position when said sensor and release assembly senses absence of said torsion and said catcher engages said grabber of said blocker to block the rotation of said torque transmitter; said blocker being at least part of a drum; a cable windable about said drum and having an end connected to said overhead door, the torsion in said spring acting through said sensor and release assembly for maintaining the catcher in the inactive position such that when said sensor and release assembly senses that the spring has broken, said sensor and release assembly allowing the catcher to be shifted outward from the inactive position into the active position thereby engaging the grabber of the blocker and preventing rotation of the torque transmitter on which the unbroken spring acts.

2. An arrangement as defined in claim 1, wherein said blocker has a wall directed substantially radially inward toward the axis; said grabber being mounted on said wall, said catcher having a section accommodated radially inside said wall and being movable radially outward into engagement with said grabber during motion of said catcher into said active position.

3. An arrangement as defined in claim 1, wherein said blocker is an annular member.

4. An arrangement as defined in claim 3, wherein said catcher has a supporting surface serving when said catcher is in the inactive position to support the catcher against a securing component movable out of the way of the catcher by said sensor and release assembly when said spring is broken, said supporting surface sloping in relation to said securing component.

5. An arrangement as defined in claim 3, wherein said blocker is a hollow trapezoidal-shaped member.

6. An arrangement as defined in claim 1, wherein said catcher comprises a pawl arm extending radially outwardly in relation to the axis and being spring-loaded for urging said catcher into said active position and said pawl arm into engagement with said grabber.

7. An arrangement as defined in claim 1, wherein said catcher is a lever having a pawl arm pivoting around an axis parallel to said axis of rotation and being resiliently biased into said active position.

8. An arrangement as defined in claim 7, wherein said lever has a second arm operating with said sensor and release assembly.

9. An arrangement as defined in claim 8, wherein said second arm pivots away from said sensor and release assembly and out of a path traveled by a securing component of said sensor and release assembly as the catcher moves into said active position.

10. An arrangement as defined in claim 9, wherein said catcher, in said active position, is positioned to allow the panel arm to be subjected to a force exerted by the overhead door through said blocker.

11. An arrangement as defined in claim 7, wherein said pawl arm has a free end comprising a lug for engaging one of the detents of said grabber, said free end having a sloping surface and said one of the detents having a matching sloping surface.

12. An arrangement as defined in claim 1, wherein said cable has said end connected at a bottom of said overhead door, said blocker being an integrated part of said drum.

* * * * *